US006046549A

United States Patent [19]

James

[11] Patent Number: 6,046,549

[45] Date of Patent: Apr. 4, 2000

[54] ENERGY SAVING LIGHTING CONTROLLER

[75] Inventor: Mark S. James, Mission Viejo, Calif.

[73] Assignee: U.S. Energy, Inc., San Clemente, Calif.

[21] Appl. No.: 08/940,042

[22] Filed: Sep. 29, 1997

[51] Int. Cl.[7] ..... H05B 37/00

[52] U.S. Cl. ..... 315/291; 315/276; 315/307

[58] Field of Search ..... 315/307, 257, 315/205, 276, 277, 291, 360

[56] References Cited

U.S. PATENT DOCUMENTS

| | | | |
|---|---|---|---|
| 4,039,897 | 8/1977 | Dragoset | 315/205 |
| 4,135,115 | 1/1979 | Abernethy et al. | 315/97 |
| 4,237,405 | 12/1980 | Kellis | 315/307 |
| 4,256,993 | 3/1981 | Morton | 315/106 |
| 4,339,690 | 7/1982 | Regan et al. | 315/97 |
| 4,434,388 | 2/1984 | Carver et al. | 315/307 |
| 4,435,670 | 3/1984 | Evans et al. | 315/58 |
| 4,464,606 | 8/1984 | Kane | 315/158 |
| 4,513,224 | 4/1985 | Thomas | 315/141 |
| 4,527,099 | 7/1985 | Capewell et al. | 315/291 |
| 4,766,352 | 8/1988 | Widmayer | 315/244 |
| 4,859,914 | 8/1989 | Summa | 315/354 |
| 4,870,340 | 9/1989 | Kral | 323/235 |
| 4,965,492 | 10/1990 | Boldwyn | 315/156 |
| 5,252,894 | 10/1993 | Bank et al. | 315/307 |
| 5,442,261 | 8/1995 | Bank et al. | 315/307 |

*Primary Examiner*—David H. Vu
*Attorney, Agent, or Firm*—Stetina Brunda Garred & Brucker

[57] ABSTRACT

An energy saving controller system providing, from one power source, one of a plurality of different voltages to a load of electrical energy consuming devices, without power interruption to the load during transition time. The system includes a power switching circuit, a current sensing circuit and a control circuit. The power switching circuit produces, at its output port, one of the different voltages in response to receipt of a control signal of regulated magnitude. The current sensing circuit measures the power switching circuit output current and produces a measured current signal. The control circuit senses an increase in the measured current signal, which indicates an increase in current demand by the load, and outputs a control signal of regulated magnitude to the power switching circuit, initiating the voltage switching.

19 Claims, 4 Drawing Sheets

ENERGY SAVING LIGHTING CONTROLLER

FIELD OF THE INVENTION

This invention relates generally to lighting control systems, and more particularly to an energy saving controller system which provides a reduced power level to a load during normal operation and switches to provide a higher power level when an increased power demand by the load is detected.

BACKGROUND OF THE INVENTION

Fluorescent lamps and high-intensity discharge lamps (HID) are popular and commonly used in many lighting systems. These lamps produce light when they are energized by a suitable power source, as a consequence of the well known gas discharge phenomenon. They require a high power level to initiate the light producing gas discharge effect but thereafter may be operated at substantially reduced power levels. This characteristic of fluorescent lamps and high-intensity discharge lamps allows various designs of energy saving lighting control systems which are capable of responding to the power demand of a load of these lamps by switching from providing a full voltage to providing a reduced voltage, or vice versa.

For example, U.S. Pat. No. 4,513,224 issued to Thomas sets forth a FLUORESCENT-LIGHTING-SYSTEM VOLTAGE CONTROLLER having a three phase transformer which includes three auto-transformer windings, each used for developing two reduced voltages. Three contactors selectively couple the full voltage and reduced voltages to the lighting systems. The contactors are switched in closed transition fashion to avoid power interruptions. An additional contactor is used for opening the winding neutral connections during the switching operation.

U.S. Pat. No. 4,766,352 issued to Widmayer sets forth a METHOD AND APPARATUS FOR STARTING AND OPERATING FLUORESCENT LAMP AND AUXILIARY BALLAST SYSTEMS AT REDUCED POWER LEVELS in which a capacitor is selected to provide effective starting of rapid start, preheat, and instant start type fluorescent lamps. A standard AC operated ballast transformer is operated at reduced power levels to achieve energy conservation. The capacitor is connected in series with the ballast primary winding and is selected to have a value producing ferroresonance within the ballast transformer primary circuit.

U.S. Pat. No. 4,527,099 issued to Capewell, et al. sets forth a CONTROL CIRCUIT FOR GAS DISCHARGE LAMPS which includes anti-parallel connected controlled rectifiers connected in series with an AC source and the ballast. A current limiting and energy diversion capacitor is connected in series with the rectifiers and in shunt with the ballast. The controlled rectifiers of the series and shunt switching assemblies are controlled such that in any given half wave, the related controlled rectifier of the shunt switching means turns on to discharge a capacitor into the normally conducting controlled rectifier of the series switching means to produce a notch in the voltage waveform applied to the inductive ballast.

U.S. Pat. No. 4,464,606 issued to Kane sets forth a PULSE WIDTH MODULATED DIMMING ARRANGEMENT FOR FLUORESCENT LAMPS which includes a base driven high frequency push-pull transistorized inverter circuit used for energizing the lamps. The inverter is pulse width modulated to effect dimming. Transitory circuitry is provided for insuring rapid turn on and off of the inverter transistors. A photoresponsive sensor responds to ambient light and illumination produced by the lamps to control the pulse width modulator accordingly.

U.S. Pat. No. 4,435,670 issued to Evans, et al. sets forth an ENERGY CONSERVING INSTANT START SERIES SEQUENCE FLUORESCENT LAMP SYSTEM WITH OVERCURRENT PROTECTION which includes a power reducing capacitor connected in series with one or both of the lamps in a two-lamp system. A protective device is connected within the circuit of the first lamp such that the high current flow produced by failure of the second lamp to start activates the protective device and prevents the system from being damaged.

U.S. Pat. No. 4,434,388 issued to Carver, et al. sets forth an ELECTRICAL LIGHTING CONTROLLER which is connected between a power line and a bank of lamps or other electrical energy consuming devices. The output level applied to the lamps is controlled by a variable autotransformer having a drive motor which in turn is controlled by an amplifier comparator circuit.

U.S. Pat. No. 4,339,690 issued to Regan, et al. sets forth an ENERGY SAVING FLUORESCENT LIGHTING SYSTEM which includes a reactants-modifying capacitor coupled in series with first and second fluorescent lamps. A filament switch is operative to conduct filament heating current during the starting of the first lamp. The filament switch is coupled between filaments at opposite ends of the first fluorescent lamp and triggers to a low impedance state in response to the lamp starting voltage.

U.S. Pat. No. 4,256,993 issued to Morton sets forth an ENERGY SAVING DEVICE FOR RAPID-START FLUORESCENT LAMP SYSTEM which is connected in a series with one lamp of a two-lamp rapid start fluorescent light system. The device includes a normally closed relay within the electrode circuit of one of the lamps and a power reducing capacitor in shunt with one of the relay's contacts. Upon turning on the system, a solid state time delay and relay coil energizing circuit is actuated which opens the relay contacts only after the lamps have been started, placing the shunt capacitor in series with the operating lamps to reduce the nominal power consumption.

U.S. Pat. No. 4,135,115 issued to Abernethy, et al. sets forth a WATTAGE REDUCING DEVICE FOR FLUORESCENT FIXTURES comprising the combination of a step-up transformer, a resistor and two capacitors, all of which are mounted externally of the ballast. The device is wired in series with the ballast and one of the lamps to allow normal ballast voltages to be delivered to the lamp circuit.

U.S. Pat. No. 4,859,914 issued to Summa sets forth a HIGH FREQUENCY ENERGY SAVING BALLAST which provides energizing signals characterized by frequencies in the range from about sixty hertz to thirty megahertz. An oscillator and transformer provide the energizing signals which are transformer-coupled to the lamp circuits.

U.S. Pat. No. 4,870,340 issued to Kral sets forth a METHOD AND APPARATUS FOR REDUCING ENERGY CONSUMPTION which includes switching apparatus for switching the load voltage off at arbitrary positions in the sine wave of the AC power applied while simultaneously providing a commutating path for any inductive current.

U.S. Pat. No. 4,965,492 issued to Boldwyn sets forth a LIGHTING CONTROL SYSTEM AND MODULE which includes a microprocessor control utilized to operate the lighting system at reduced power level while maximizing efficiency. The microprocessor and control circuitry continuously monitors the power applied and maintains the desired power level to maintain the preestablished light level selected.

While the foregoing described prior art systems have in various ways achieved energy saving and in many instances improved lighting characteristics, they are often complex and expensive to install and maintain. Thus, there remains a continuing need in the art for evermore improved and reliable lighting control systems which provide energy savings to the consumer.

In recognition of this need, the subject assignee has previously developed an improved lighting controller as disclosed in U.S. Pat. No. 5,442,261. Although such system has proven generally effective, there exists a need to prevent power interruption to the load and high transient current circulating through the components of the system during the switching from one voltage level to the other, without having recourse to using expensive components. A power interruption to the load when the system switches from full voltage to reduced voltage would cause the plasma in the fluorescent or high-intensity discharge lamps to quench and require a start-up cycle at full voltage to reheat.

The present invention addresses the above problem by providing a system which utilizes inexpensive components to perform the voltage switching function without power interruption to the load and without high current circulating through the components during the voltage switching.

SUMMARY OF THE INVENTION

The present invention discloses an energy saving controller system which provides, from one power source, one of a plurality of different voltages to a load of electrical energy consuming devices, without power interruption to the load during transition time. The system includes a power switching circuit, a current sensing circuit and a control circuit. The power switching circuit produces, at its output port, one of the different voltages in response to receipt of a control signal of regulated magnitude. The current sensing circuit measures the power switching circuit output current and produces a measured current signal. The control circuit senses an increase in the measured current signal, which indicates an increase in current demand by the load, and outputs a control signal of regulated magnitude to the power switching circuit, initiating the voltage switching. Regulating the magnitude of the control signal means turning the control signal on or off, or setting it at a value within a range.

The power switching circuit performs the voltage switching function without power interruption to the load and without high current circulating through the components during the voltage switching, utilizing a small and inexpensive step-down transformer which is rated for handling only a small fraction of the full voltage and power of the power source. The secondary winding of the step-down transformer is connected in series with the positive terminal of the power source, while the primary winding is coupled to the power source, via a relay, such that the primary and the secondary windings have opposite polarities. This configuration causes the voltage developed across the output terminal of the secondary winding and the negative terminal of the power source to be approximately equal to the difference between the power source voltage and the voltage across the secondary winding, when the relay is activated by a control signal of non-zero magnitude from the control circuit. When the relay is de-activated by the absence of the control signal, the relay disconnects the primary winding from the power source voltage then short-circuits the primary winding, thereby causing the secondary winding to be substantially short-circuited and the voltage developed across the output terminal of the secondary winding and the negative terminal of the power source to be approximately equal to the power source voltage. Since the secondary winding remains connected to the power source during the switching, there is no power interruption to the load. Additionally, since the current circulating through the primary winding before the switching is only equal to a small fraction of the full rated current flowing through the secondary winding, the switching only involves diversion of a very small current flowing in the primary winding. Thus, a small and reliable relay can be used for this purpose. Also, since the full power source voltage is provided to the load in the absence of the control signal, the system is fail-safe, i.e., still operative even when the control circuit fails.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE INVENTIONS

The detailed description set forth below in connection with the appended drawings is intended as a description of the presently preferred embodiment of the invention, and is not intended to represent the only form in which the present invention may be constructed or utilized. The description sets forth the functions and the sequence of the steps for constructing and operating the invention in connection with the illustrated embodiment. It is to be understood, however, that the same or equivalent functions may be accomplished by different embodiments that are also intended to be encompassed within the spirit and scope of the invention.

In the presently preferred embodiment of the invention, the energy saving controller system provides, from one power source, one of two different voltages to a load of electrical energy consuming devices. Those skilled in the art will recognize that the embodiment can be easily modified to provide one of more than two different voltages to the load.

Figure 1:
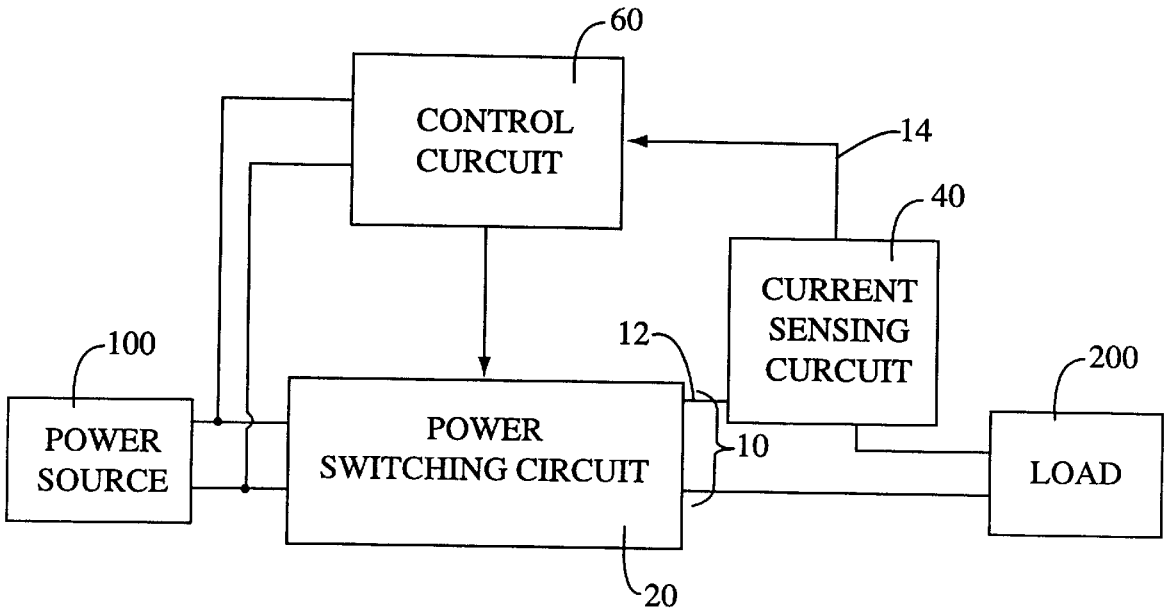
FIG. 1 is a block diagram of the energy saving controller system of the present invention.

FIG. 1 shows a block diagram of an energy saving controller system constructed in accordance with the present invention. The energy saving controller system is comprised primarily of a power switching circuit 20 in electrical communication with the power source 100, a current sensing circuit 40 connected to the positive terminal 12 of the output port 10 of the power switching circuit 20, and a control circuit 60, in electrical communication with the power switching circuit 20 and the current sensing circuit 40.

The power switching circuit 20 produces the smaller of two different voltages at its output port 10 upon receipt of a control signal from the control circuit 60, and the larger voltage at its output port 10 in the absence of the control signal.

The current sensing circuit 40 measures the current at terminal 12 of the power switching circuit 20 and produces a measured current signal at its output 14. An increase in the measured current signal indicates either an increase in current demand by the load 200 or an increase in the power source 100 voltage, or both. An increase in current demand by the load 200, called an increase in load, indicates that at least one additional light has just been turned on in the load 200.

The control circuit 60 monitors the power source 100 voltage and the measured current signal. When the control circuit 60 senses an increase in the measured current signal which is unrelated to an increase in the power source 100 voltage, this indicates an increase in current demand by the load 200. The control circuit 60 then stops outputting a control signal to the power switching circuit 20, in response to this sensed increase in the measured current signal.

Figure 2:
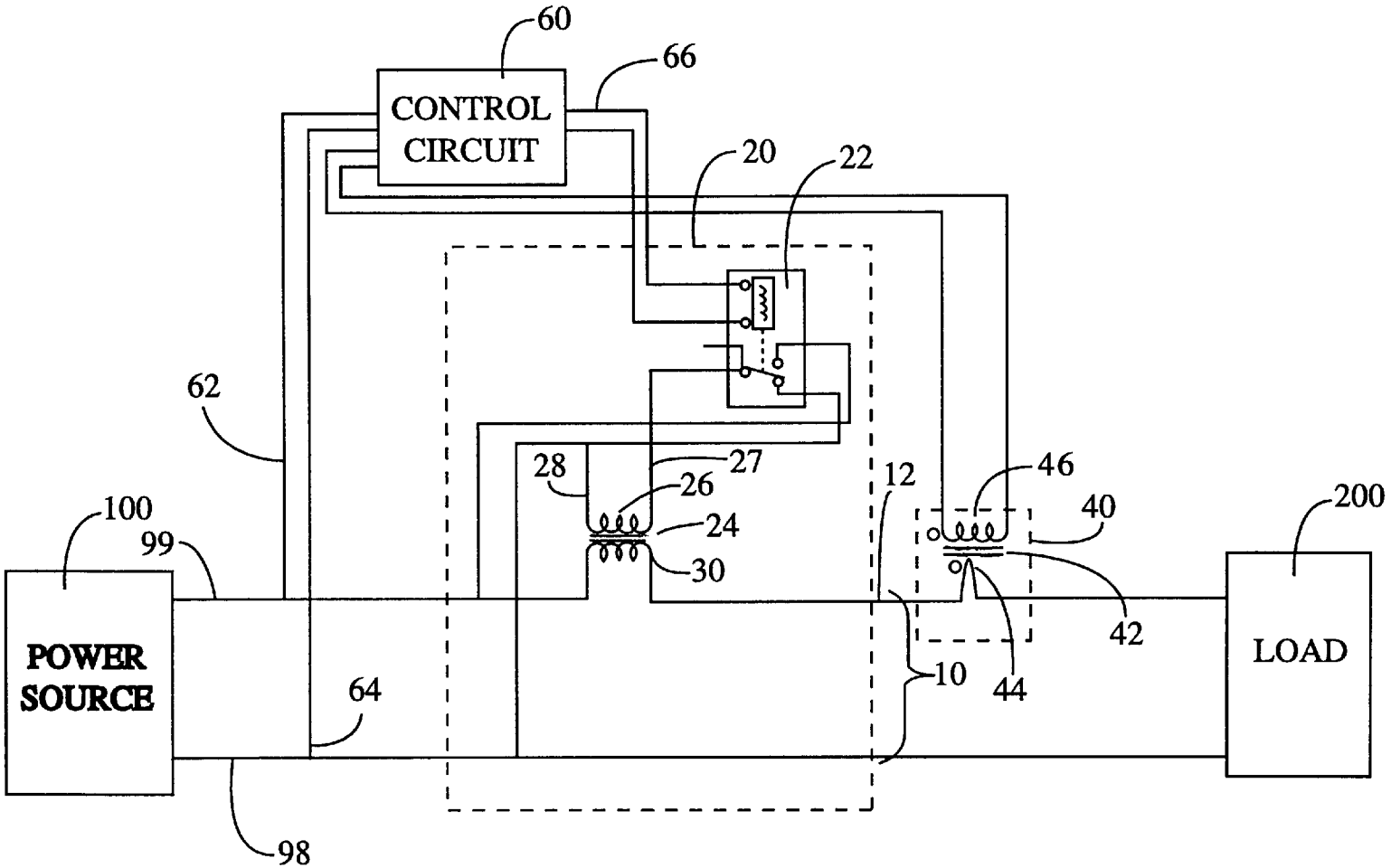
FIG. 2 is a schematic diagram of the power switching circuit and the current sensing circuit.

FIG. 2 shows a schematic diagram of the power switching circuit 20 and the current sensing circuit 40 in the presently preferred embodiment of the invention.

Referring now to FIG. 2, the power switching circuit 20 comprises a relay 22 and a step-down transformer 24. The relay 22 is coupled to the control circuit 60 at relay terminals 1 and 2, and coupled to the power source 100 at relay terminals 6 and 5. The step-down transformer 24 comprises a primary winding 26 and a secondary winding 30. The secondary winding 30 is connected in series between the positive terminal 99 of the power source 100 and the positive terminal 12 of the output port 10. The primary winding 26 is coupled to the power source 100 such that the primary winding 26 and the secondary winding 30 have opposite polarities. Terminal 27 of primary winding 26 is connected to terminal 4 of relay 22. Terminal 28 of primary winding 26 is connected to terminal 5 of relay 22, which is connected to the negative terminal 98 of the power source 100. When a control signal from control circuit 60 is applied to terminal 1 of relay 22, terminals 4 and 6 of relay 22 are connected together, causing the primary winding 26 to be coupled to the power source 100. The voltage developed across the primary winding 26 is approximately equal to the power source 100 voltage. This in turn causes a smaller voltage, polarity of which is opposite that of the primary winding 26, to appear across the secondary winding 30. Consequently, the voltage across the output port 10 is approximately equal to the difference between the power source 100 voltage and the voltage across the secondary winding 30. If the step-down ratio of transformer 24 is n to 1, then the secondary winding 30 voltage is approximately one nth of the power source 100 voltage. For example, if the step-down ratio of transformer 24 is 10 to 1 and the power source 100 voltage is 120 volts AC, then applying 120 volts AC to the primary winding 26 causes approximately 12 volts AC to appear across the secondary winding 30 and a reduced voltage of approximately 108 volts AC to develop across the output port 10. An advantage of this configuration is that, while the primary winding 26 is rated for the full voltage of the power source 100, the secondary winding 30 needs to be rated only for a small fraction of the full voltage and of the full power. For the step-down ratio of 10 to 1, the secondary winding 30 is rated for one tenth of full voltage. Thus, a small and inexpensive transformer can be used for this purpose.

When the control circuit 60 determines that there is an increase in current demand by the load 200, the control circuit 60 stops producing the control signal at terminal 66 which is connected to terminal 1 of relay 22. This removal of the control signal de-activates relay 22, causing its terminal 4 to be disconnected from its terminal 6 and to be connected to its terminal 5. The disconnection of relay terminal 4 from relay terminal 6 disconnects the primary winding 26 from the power source 100 voltage. The connection of relay terminal 4 to relay terminal 5 shortcircuits the primary winding 26. This short-circuit is reflected to the secondary winding 30, causing the secondary winding 30 to have a very low impedance and passes approximately the full voltage of the power source 100 to the output port 10. Since the secondary winding 30 is never disconnected from terminal 99 of the power source 100, the transition from the reduced voltage to the full voltage, or vice versa, at the output port 10 is effected without power interruption to the load 200.

Switching between the two different voltages without power interruption to the load is an important feature of the invention. If the load 200 is comprised of fluorescent lamps or high intensity discharge lamps, a power interruption to the load 200 would cause the plasma in the lamps to quench and would require a start-up cycle at full voltage to re-heat the plasma.

Another advantage of the configuration of the power switching circuit 20 is that switching from full voltage mode to reduced voltage mode only requires switching the primary winding 26 current. Since this current is only a small fraction (10% in the above example) of the full rated current, a small, thus reliable, relay can be used to implement relay 22. Furthermore, there is no high circulating current in the system during the switching. Instead of a relay, a solid state switch can be used for the function of relay 22. However, solid state switches are more susceptible to damages by transients on the power source line than relays.

The current sensing circuit 40 comprises a current transformer 42 which includes a primary winding 44 and a secondary winding 46. The primary winding 44 is connected to the positive terminal 12 of the power switching circuit 20. The secondary winding 46 is coupled to the control circuit 60. The current flowing through the secondary winding 46 is equal to a fraction of the current flowing out of terminal 12 and through primary winding 44, and serves as a measured current signal to the control circuit 60.

An increase in the measured current signal indicates either an increase in current demand by the load 200 or an increase in the power source 100 voltage, or both. An increase in current demand by the load 200, called an increase in load, indicates that at least one additional light has just been turned on in the load 200. In order to calculate an increase of power due to an increase in load, that is unrelated to an increase caused by a power source 100 voltage increase, the control circuit 60 is coupled to the power source 100 at terminals 62 and 64 to monitor the power source 100 voltage. When the control circuit 60 determines that the current increase is due to an increase in load, the control circuit 60 stops producing a control signal at terminal 66 which is connected to input 1 of relay 22. This removal of the control signal de-activates relay 22, causing its terminal 4 to be disconnected from its terminal 6 and to be connected to its terminal 5. This causes the power switching circuit 20 to switch to outputting the full voltage at its output port 10, as discussed above.

Figure 3:
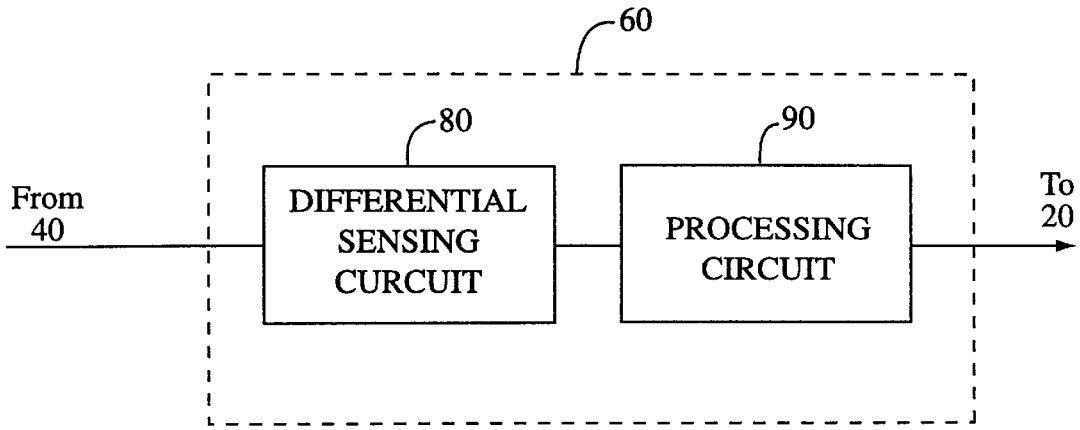
FIG. 3 is a block diagram of the control circuit.
Figure 4:
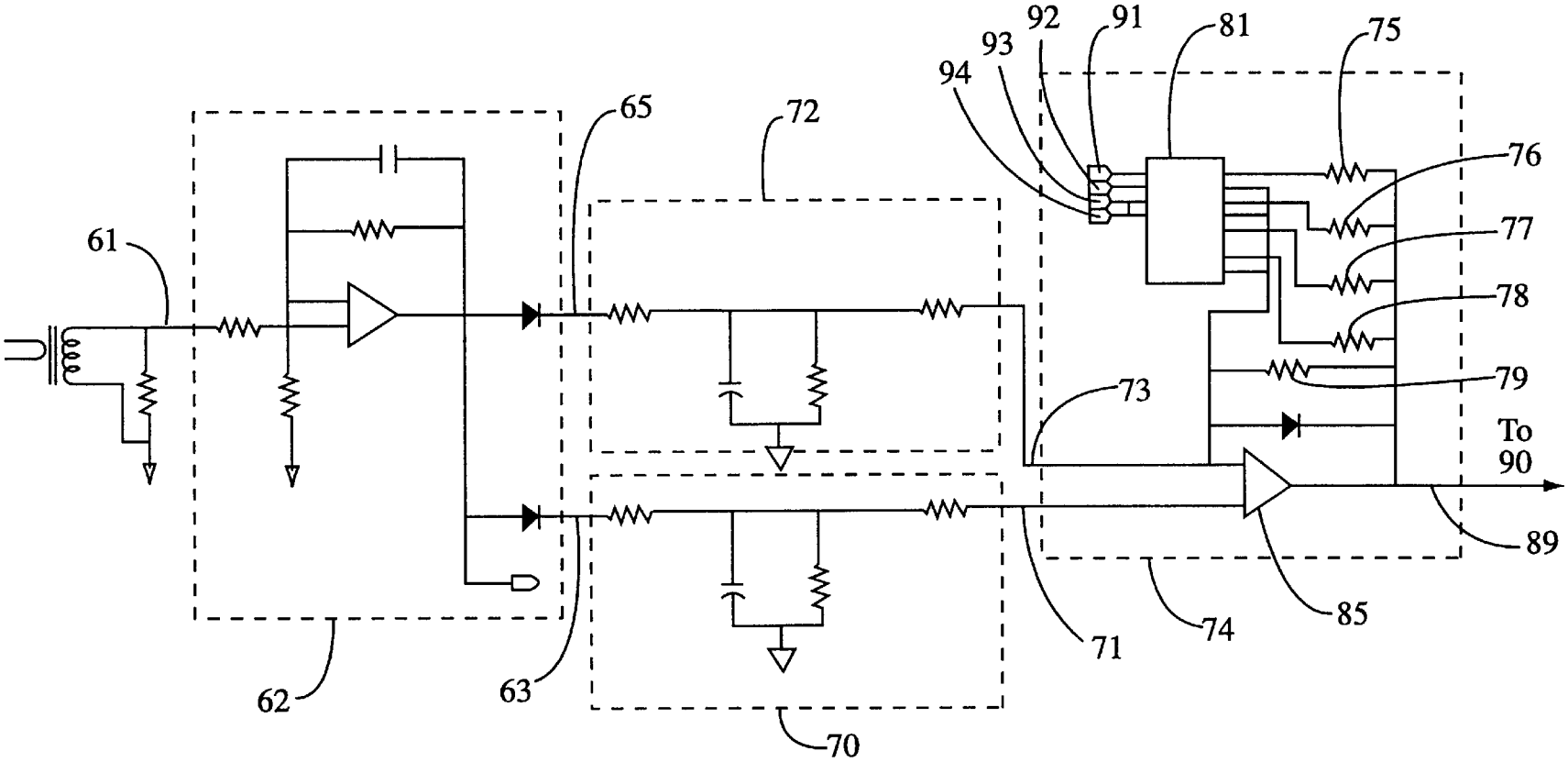
FIG. 4 is a schematic diagram of the differential sensing circuit which is an element of the control circuit.

Referring to FIG. 3, the control circuit 60 comprises a differential sensing circuit 80 and a processing circuit 90. FIG. 4 depicts a schematic diagram of the differential sensing circuit 80, which comprises a rectifier circuit 62, a first filter circuit 70, a second filter circuit 72 and a variable gain differential amplifier 74.

In FIG. 4, the measured current signal, from the current sensing circuit 40 in FIG. 1, enters the rectifier circuit 62 at terminal 61. The rectifier circuit 62 amplified and rectified the measured current signal then produces the resulting signal at the two outputs 63 and 65 which are connected to the first filter circuit 70 and the second filter circuit 72, respectively. The two filter circuits 70 and 72 are simple resistor-capacitor filter circuits. The first filter circuit 70 has a shorter time constant than the second filter circuit 72. The resulting filtered signals, from the two filter circuits 70 and 72, enter the variable gain differential amplifier 74 at its inputs 71 and 73, respectively. Amplifier 74 compares the two filtered signals. If the shorter time constant signal at input 71 is significantly higher than the longer time constant signal at input 73, this indicates that a current increase has occurred. In such a case, the variable gain differential amplifier 74 produces a trigger signal at its output 89 to the processing circuit 90. The gain of the amplifier 85 is regulated by four bidirectional analog switches residing in component 81 in conjunction with the resistors 75, 76, 77, 78 and 79. In the presently preferred embodiment of the invention, component 81 is implemented by a quad analog switch, model number 74HC4016. The analog switches of component 81 are selected to be on or off by the processing circuit 90 through terminals 91, 92, 93 and 94. The gain of amplifier 85 is closely related to the sensitivity of the differential sensing circuit 80.

In the presently preferred embodiment of the invention, the processing circuit 90 is a microprocessor having a non-volatile memory for storing the settings used in controlling the sensitivity of the differential sensing circuit 80 and the duration of the control signal. The settings can be user-defined or resulting from adaptive control algorithms. To obtain settings determined by adaptive control algorithms, the processing circuit 90 monitors the voltage and current supplied to the load 200 over a period of time. The processing circuit 90 is connected to a visual display to show the status of the system, and a computer interface to receive inputs from a user. Using the computer interface which includes a keypad, a front panel and a visual display, the user can input the settings for current sensitivity of the differential sensing circuit 80 and for the amount of time the system will run at full power mode, that is, the duration of the control signal outputted from the control circuit 60. These settings can be changed while the system is running. These settings are saved in the non-volatile memory of the microprocessor 90 so that they will be retained when the system is turned off, even for as long as ten years, and are reloaded automatically when the system is turned on again. Through the computer interface, the user can also manually control the system, running the system at full power mode or reduced power mode at will, overriding the automatic control.

The microprocessor 90 monitors the voltage and current supplied to the load 200 during full voltage cycles and reduced voltage cycles, and calculates the amount of energy saved. The microprocessor 90 outputs to the visual display information about the system load 200 and the amount of energy saved.

The microprocessor 90 can monitor three phases of power simultaneously and control each phase independently for efficient operation of the lights. Thus, a three-phase configuration of the present invention can be implemented using three power switching circuits, three current sensing circuits, three differential sensing circuits and one processing circuit.

It is understood that the exemplary energy saving controller system described herein and shown in the drawings represents only a presently preferred embodiment of the invention. Indeed, various modifications and additions may be made to such embodiment without departing from the spirit and scope of the invention. For example, the embodiment can be modified to provide switching between more than two different voltages. For another example, the two filter circuits and the variable gain differential amplifier of the differential sensing circuit need not be configured as illustrated. Also, the functions of the differential sensing circuit can be emulated by a software program residing in the microprocessor. Those skilled in the art will recognize that various other configurations are equivalent and therefore likewise suitable. Thus, these and other modifications and additions may be obvious to those skilled in the art and may be implemented to adapt the present invention for use in a variety of different applications.

What is claimed is:

1. An energy saving controller system providing, from one power source having a positive terminal and a negative terminal, one of a plurality of different voltages to a load including at least one electrical energy consuming device, the system comprising:

(a) a power switching circuit, in electrical communication with the power source, for producing one of the plurality of different voltages at an output port in response to a control signal of regulated magnitude, said power switching circuit being configured to effect switching between the different voltages without power interruption to the load;

(b) a current sensing circuit, in electrical communication with the output port of the power switching circuit, for measuring current at said output port and for producing a measured current signal; and (c) a control circuit in electrical communication with the power source, the power switching circuit, and the current sensing circuit, said control circuit for sensing an increase in the measured current signal from the power switching circuit with said increase unrelated to an increase in voltage of the power source, for outputting the control signal to the power switching circuit, and for regulating the magnitude of the control signal in response to the sensed increase in the measured current signal.

2. The energy saving controller system as recited in claim 1 wherein the power switching circuit comprises:

(a) a relay coupled to the control circuit for receiving the control signal; and (b) a step-down transformer comprising a primary winding and a secondary winding, said secondary winding being connected in series between the positive terminal of the power source and the positive terminal of the output port, said primary winding being coupled to the power source via the relay such that the primary winding and the secondary winding have opposite polarities, thereby causing the voltage across the output port to be approximately equal to a difference between the power source voltage and the voltage across the secondary winding;

(c) wherein, upon receipt of the control signal of regulated magnitude, the relay disconnects the primary winding from the power source voltage then short-circuits the primary winding, thereby causing the secondary winding to be substantially short-circuited and the voltage across the output port to be approximately equal to the power source voltage.

3. The energy saving controller system as recited in claim 1 wherein the current sensing circuit comprises a current transformer.

4. The energy saving controller system as recited in claim 1 wherein the control circuit comprises:

(a) a differential sensing circuit for sensing an increase in the measured current signal and for producing a trigger signal thereupon; and (b) a processing circuit, coupled to the differential sensing circuit, for producing the control signal, for regulating the magnitude of the control signal in response to receipt of said trigger signal, for controlling duration of the control signal, and for regulating sensitivity of the differential sensing circuit.

5. The energy saving controller system as recited in claim 4 wherein the differential sensing circuit comprises:

(a) a rectifier circuit for rectifying the measured current signal and producing a rectified signal;

(b) a first filter circuit, having a first time constant, coupled to the rectifier circuit, for filtering the rectified signal and producing a first filtered signal;

(c) a second filter circuit, having a second time constant different from the first time constant, coupled to the rectifier circuit, for filtering the rectified signal and producing a second filtered signal; and (d) a differential amplifier circuit for producing the trigger signal, said differential amplifier circuit receiving the first filtered signal at a first input and the second filtered signal at a second input, the trigger signal being an amplified difference of the two filtered signals.

6. The energy saving controller system as recited in claim 4 wherein the differential sensing circuit comprises:

(a) a rectifier circuit for rectifying the measured current signal and producing a rectified signal;

(b) a first filter circuit, having a first time constant, coupled to the rectifier circuit, for filtering the rectified signal and producing a first filtered signal;

(c) a second filter circuit, having a second time constant different from the first time constant, coupled to the rectifier circuit, for filtering the rectified signal and producing a second filtered signal; and (d) a variable gain differential amplifier circuit for producing the trigger signal, said differential amplifier circuit receiving the first filtered signal at a first input and the second filtered signal at a second input, the trigger signal being an amplified difference of the two filtered signals, the gain of said differential amplifier circuit being regulated by the processing circuit, said gain being closely related to sensitivity of the differential sensing circuit.

7. The energy saving controller system as recited in claim 4 wherein the processing circuit comprises a non-volatile memory for storing settings used in regulating the duration of the control signal and the sensitivity of the differential sensing circuit, said settings being selected from the group of user-defined settings and settings resulting from adaptive control algorithms.

8. The energy saving controller system as recited in claim 4 wherein the processing circuit comprises a microprocessor.

9. The energy saving controller system as recited in claim 1 further comprises:

(a) a visual display, in electrical communication with the control circuit, for showing status of the system; and (b) a computer interface, in electrical communication with the control circuit, for receiving inputs from a user.

10. The energy saving controller system as recited in claim 5 wherein the first and second filter circuits comprise resistor-capacitor filter circuits.

11. The energy saving controller system as recited in claim 6 wherein the first and second filter circuits comprise resistor-capacitor filter circuits.

12. The energy saving controller system as recited in claim 6 wherein the variable gain differential amplifier circuit includes an amplifier circuit, a plurality of resistors for determining a gain of said amplifier circuit and a plurality of analog switches for selecting at least one resistor from the plurality of resistors to vary the gain of said amplifier circuit.

13. The energy saving controller system as recited in claim 1 wherein the control circuit regulates the magnitude of the control signal in response to the sensed increase in the measured current signal by reducing the magnitude of the control signal to approximately zero, thereby allowing the power switching circuit to produce one of the different voltages at the output port in the absence of the control signal.

14. A method for providing, from one power source, one of a plurality of different voltages to a load including at least one electrical energy consuming device, wherein switching between the different voltages is effected without power interruption to said load, the method comprising:

(a) measuring current being supplied to the load from an output port of a power switching circuit, said circuit comprising a relay and a step-down transformer, said transformer including a primary winding and a secondary winding, said secondary winding being connected in series between the positive terminal of the power source and a positive terminal of the output port, said primary winding being coupled to the power source via the relay such that the primary winding and the secondary winding have opposite polarities, thereby causing the voltage across the output port to be equal to a difference between the power source and the voltage across the secondary winding;

(b) producing a measured current signal from the power switching circuit and unrelated to an increase in voltage of the power source;

(c) applying the measured current signal to a control circuit to sense an increase in the measured current signal;

(d) outputting a control signal for a specified duration from the control circuit;

(e) regulating the magnitude of the control signal in response to said increase in the measured current signal;

(f) applying the control signal of regulated magnitude to the power switching circuit; and (g) producing a voltage approximately equal to the power source voltage, for the specified duration, at the output port of the power switching circuit.

15. The method as recited in claim 14 wherein the step of applying the measured current signal to a control circuit to sense an increase in the measured current signal further comprises the steps of:

(a) rectifying the measured current signal;

(b) filtering the rectified signal through two filter circuits having different time constants;

(c) producing a first filtered signal and a second filtered signal;

(d) subtracting the first filtered signal from the second filtered signal to obtain a difference signal;

(e) amplifying the difference signal to produce a trigger signal; and (f) applying the trigger signal to a control circuit.

16. The method as recited in claim 14 wherein the step of applying the control signal of regulated magnitude to the power switching circuit further comprises the steps of:

(a) applying the control signal of regulated magnitude to the relay of the power switching circuit;

(b) disconnecting the primary winding from the power source voltage; and (c) short-circuiting the primary winding, thereby causing the secondary winding to be substantially short-circuited and the voltage across the output port of the power switching circuit to be approximately equal to the power source voltage.

17. The method as recited in claim 14 wherein the step of regulating the magnitude of the control signal in response to the increase in the measured current signal comprises the step of reducing the magnitude of the control signal to approximately zero.

18. An energy saving controller system providing, from one power source having a positive terminal and a negative terminal, one of a plurality of different voltages to a load including at least one electrical energy consuming device, the system comprising:

(a) a power switching circuit, in electrical communication with the power source, for producing one of the plurality of different voltages at an output port in response to a control signal of regulated magnitude, said power switching circuit being configured to effect switching between the different voltages without power interruption to the load;

(b) a current sensing circuit, in electrical communication with the output port of the power switching circuit, for measuring current at said output port and for producing a measured current signal; and (c) a control circuit, in electrical communication with the power switching circuit and the current sensing circuit, for sensing an increase in the measured current demand by the load, for outputting the control signal to the power switching circuit, and for regulating the magnitude of the control signal in response to the sensed increase in the measured current signal, said control circuit comprising:

(i) a differential sensing circuit for sensing an increase in the measured current signal and for producing a trigger signal thereupon; and (ii) a processing circuit comprising a microprocessor, coupled to the differential sensing circuit, for producing the control signal, for regulating the magnitude of the control signal in response to receipt of said trigger signal, for controlling duration of the control signal, and for regulating sensitivity of the differential sensing circuit.

19. An energy saving controller system providing, from one power source having a positive terminal and a negative terminal, one of a plurality of different voltages to a load including at least one electrical energy consuming device, the system comprising:

(a) a power switching circuit, in electrical communication with the power source, for producing one of the plurality of different voltages at an output port in response to a control signal of regulated magnitude, said power switching circuit being configured to effect switching between the different voltages without power interruption to the load;

(b) a current sensing circuit, in electrical communication with the output port of the power switching circuit, for measuring current at said output port and for producing a measured current signal;

(c) a control circuit, in electrical communication with the power switching circuit and the current sensing circuit, for sensing an increase in the measured current demand by the load, for outputting the control signal to the power switching circuit, and for regulating the magnitude of the control signal in response to the sensed increase in the measured current signal;

(d) a visual display, in electrical communication with the control circuit, for showing status of the system; and (e) a computer interface, in electrical communication with the control circuit, for receiving inputs from a user.

* * * * *